US005639250A

United States Patent [19]

Neef et al.

[11] Patent Number: 5,639,250

[45] Date of Patent: Jun. 17, 1997

[54] TERMINAL STRIP

[75] Inventors: Karl-Heinz Neef, Baltmannsweiler; Thomas Kessler, Lorch, both of Germany

[73] Assignee: ITT Corporation, New York, N.Y.

[21] Appl. No.: 510,320

[22] Filed: Aug. 1, 1995

[30] Foreign Application Priority Data

Aug. 3, 1994 [DE] Germany ..... 44 27 451.3

[51] Int. Cl.[6] ..... H01R 9/09

[52] U.S. Cl. ..... 439/79; 29/874

[58] Field of Search ..... 29/874; 439/79, 439/80, 701, 717

[56] References Cited

U.S. PATENT DOCUMENTS

| | | | |
|---|---|---|---|
| 4,343,528 | 8/1982 | Lucius et al. | 439/701 |
| 5,104,341 | 4/1992 | Gilissen et al. | 439/79 |
| 5,133,679 | 7/1992 | Fusselman et al. | 439/79 |
| 5,336,110 | 8/1994 | Mosquera | 439/554 |

FOREIGN PATENT DOCUMENTS

| | | |
|---|---|---|
| 0408212A1 | 1/1991 | European Pat. Off. . |
| 0422785A2 | 4/1991 | European Pat. Off. . |

*Primary Examiner*—Neil Abrams
*Assistant Examiner*—Barry Matthew L. Standig
*Attorney, Agent, or Firm*—Thomas L. Peterson

[57] ABSTRACT

A terminal strip is described, of the type that includes connector modules that can be mounted end-to-end on a circuit board to provide a strip having the desired number of contact positions, which minimizes the number of separate connector modules that must be mounted, which minimizes the number of different module lengths that must be manufactured, and which increases the stability of the connector modules. Where rear modules are mounted to the rear of the connector front modules, the front and rear modules are laterally offset. Different length modules, that is, modules with different numbers of columns of contact positions, are manufactured, with the smallest module having a predetermined number of columns, the second smallest size having twice as many columns as the smallest, and the third largest size having four times as many columns as the first. Similar lengths of rear modules are provided.

7 Claims, 6 Drawing Sheets

TERMINAL STRIP

BACKGROUND OF THE INVENTION

One type of right angle board-mounted electrical connector has a housing that is mounted on a circuit board and that has a mating end. The connector housing has several columns of contact positions where contacts are mounted (although some contact positions may not be occupied by a contact). Each contact has a socket end at a contact position and has a tail that extends down to a circuit board trace. Such connectors are commonly available in modules that each have six columns, with four contact positions in each column for a total of twenty-four contact positions.

Where a large number of contacts are required, the modules are placed end-to-end in a laterally-extending row. Where a very large number of contact positions is required, such as hundreds, the need to handle and mount each of many connector modules, or front modules, adds to the cost. The required number of contacts that may be required by a customer is unpredictable, so manufacturers have commonly produced only small modules with six columns of contact positions each. It is noted that customers generally do not want to have an oversized strip that has many more contact positions than the customer requires for a particular application, since the customer's circuit board may not hold a longer strip and a customer does not wish to pay for many unused contact positions.

Terminal strips formed of front modules, are often stabilized by stabilizer rear modules that lie behind the front modules and that shield the contact tails while increasing the stability of the modules. One approach is for a manufacturer to produce meter-long stabilizer bars, and to cut the bar into sections equal to the length of the row of connector modules. The requirement for cutting reduces flexibility and adds to the cost for initial molding and for precision cutting. In another arrangement for a stabilizer, rear modules are provided, that are each equal to the length of a small front module. This results in the need for a large number of rear modules as well as front modules. Also, the short stabilizer modules cannot connect the short connector modules together to stabilize them on one another.

A system for providing connector modules, or front modules, which minimized the number of individual modules required to provide the desired number of contact positions with only a small excess, and which minimize the number of different module sizes that must be manufactured and inventoried by a manufacturer, would be desirable. If such a system permitted rear modules to be provided so a minimum number could be used, chosen from a limited number of different sizes, with the rear modules connecting adjacent front modules together, such a system would also be desirable.

SUMMARY OF THE INVENTION

In accordance with one embodiment of the present invention, a terminal strip and manufacturing method are provided which enable the use of a small number of individual modules for a wide variety of terminal strip lengths while minimizing the number of different module sizes that must be manufactured and inventoried; also, the invention provides the same benefit for rear modules while enabling the rear modules to connect adjacent front modules together. The front and rear modules are laterally offset, in that the adjacent ends of two rear modules are offset from the adjacent ends of two front modules. The front modules are constructed in a plurality of different sizes, with the smallest size having a predetermined number of columns of contact positions, with the second smallest size having twice as many contact positions as the smallest size, and with the third smallest size having four times the contact positions as the smallest size.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
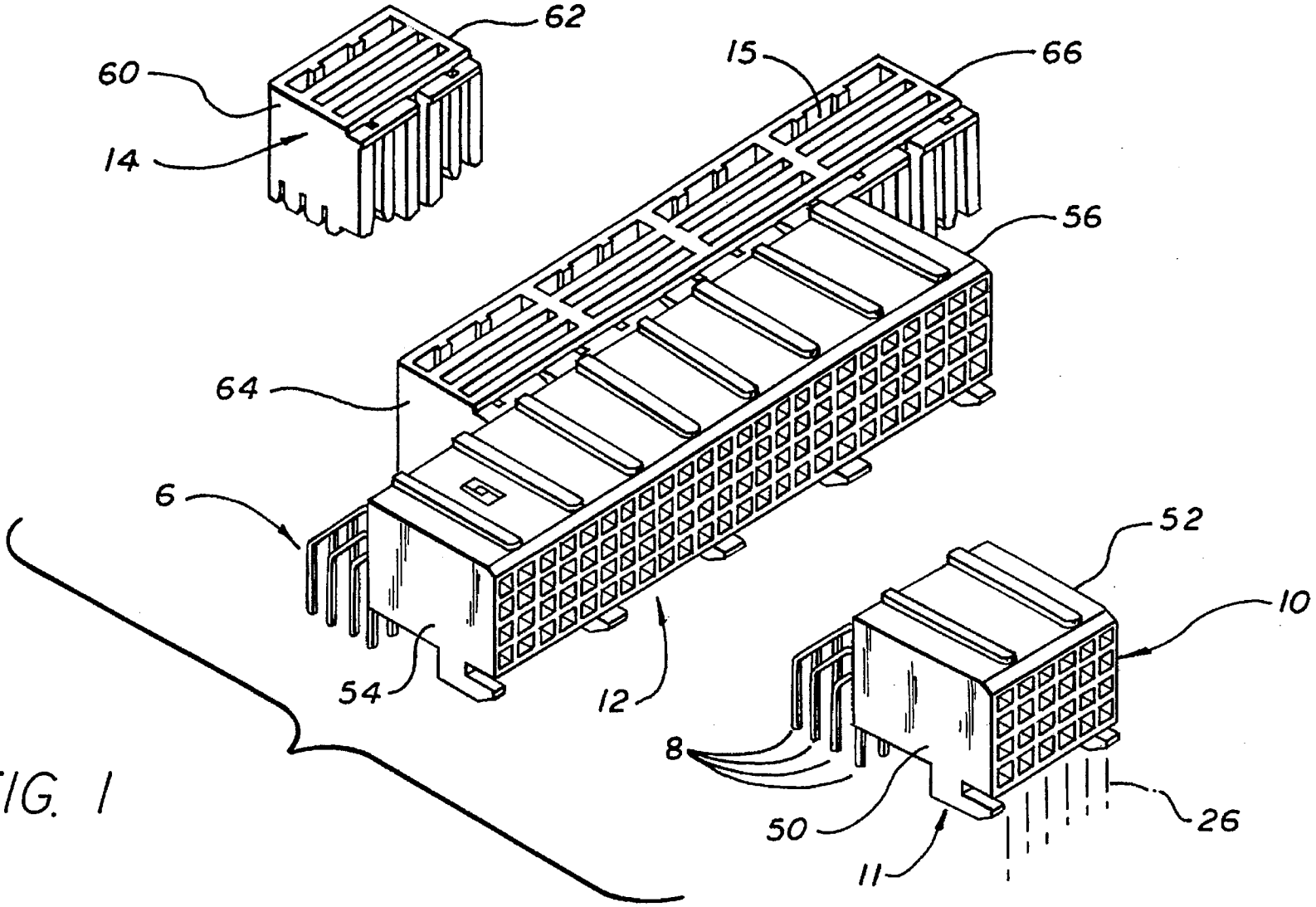
FIG. 1 is an exploded isometric view of a socket terminal strip constructed in accordance with one embodiment of the present invention.
Figure 2:
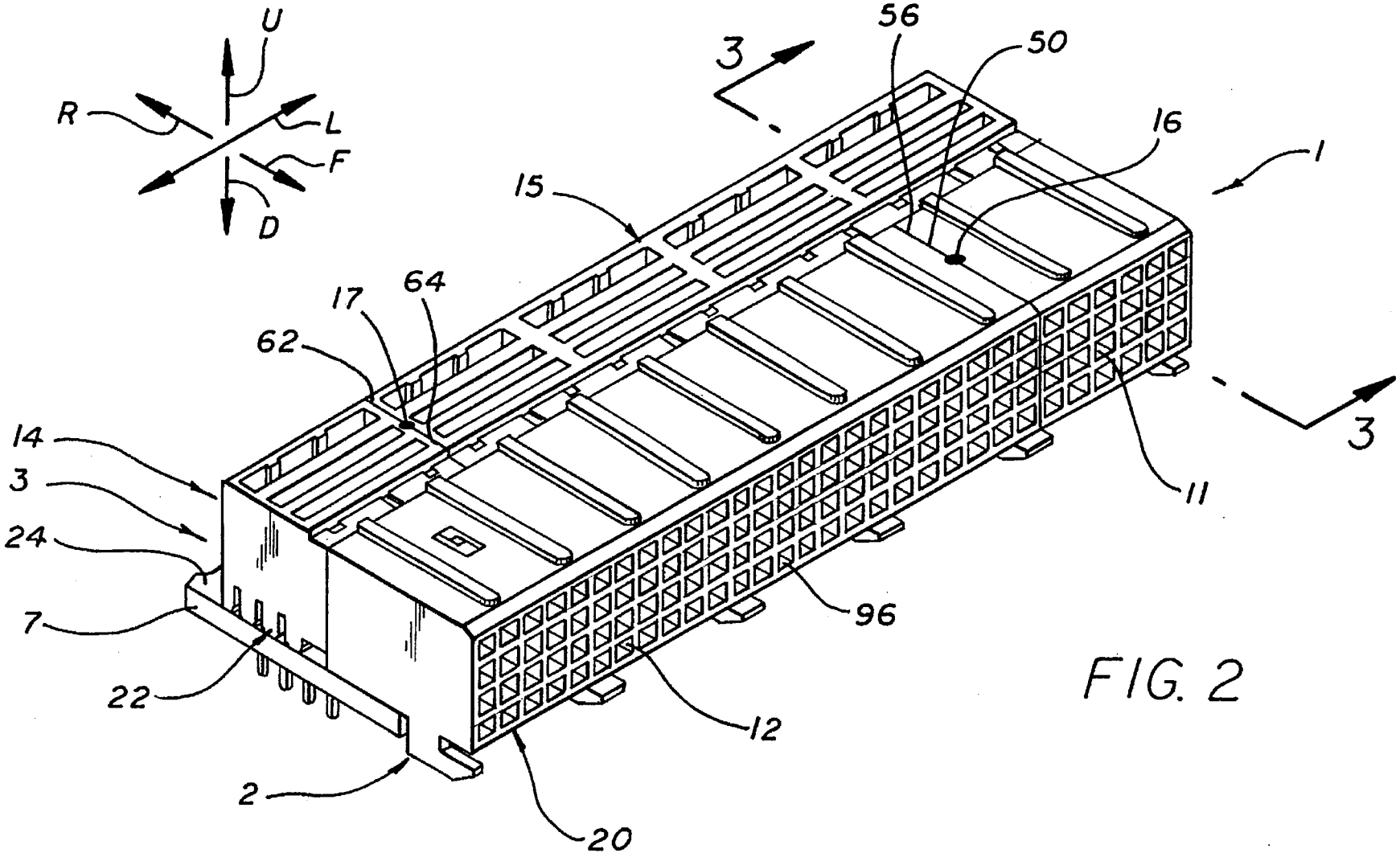
FIG. 2 is a view of the terminal strip of FIG. 1, shown assembled to a circuit board.

FIG. 2 illustrates a terminal strip 1 which is mounted on a circuit board 7. The particular terminal strip includes a row 2 of front modules that are mounted on the circuit board, and a row 3 of rear modules 22 that are attached to the front modules. Front, rear, up, down, and lateral directions are indicated by arrows F, R, U, D and L. Each row of modules extends in the lateral direction L, with the front modules opening in the forward direction F, in the plane of the circuit board, and with the rear modules lying rearward of the front modules. The modules generally lie above a top face 24 of the circuit board. As shown in FIG. 1, each front module such as the first one 11 has twenty-four contact positions 10, that are arranged in six columns 26, with each column having four vertically-spaced contact positions. The particular second module 12 has twenty-four columns of contacts and ninety-six contact positions, which is four times as many as for the first module 11.

Figure 3:
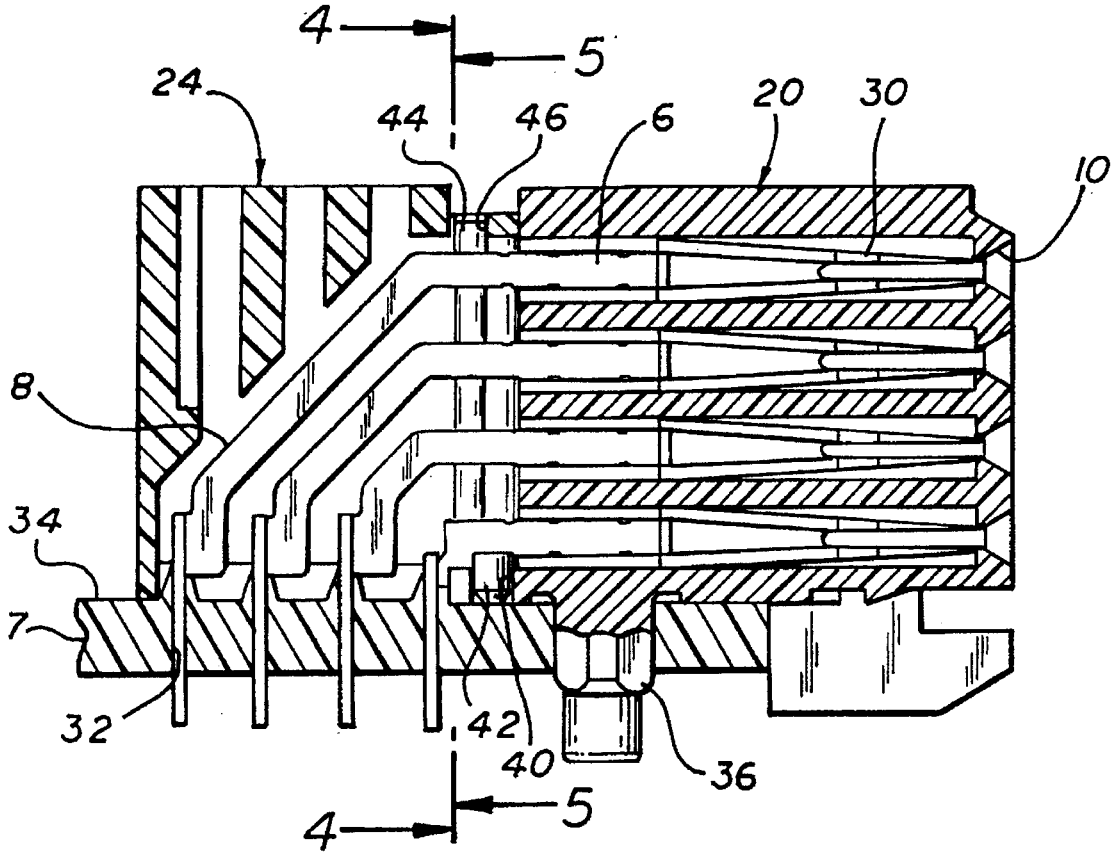
FIG. 3 is a view taken on line 3—3 of FIG. 2.

FIG. 3 is a sectional view of the terminal strip, showing four contacts 6. Each contact has a socket end 30 lying at a contact position 10, and has a free end or tail 8 that extends rearwardly and downwardly and which lies in a plated hole 32 of the circuit board 7. Each plated hole is integral with a conductive trace 34 of the board, which can lead to electronic components on the board. The front module 20 has pegs 36 that enter unplated holes in the board to secure the front module to the board. The rear module 24 has pegs 40 that are received in holes 42 of the front module, while the front module has pegs 44 that are received in holes 46 of the rear module. Also, as indicated in FIG. 4, the modules have snap-together parts 46, 48.

Figure 4:
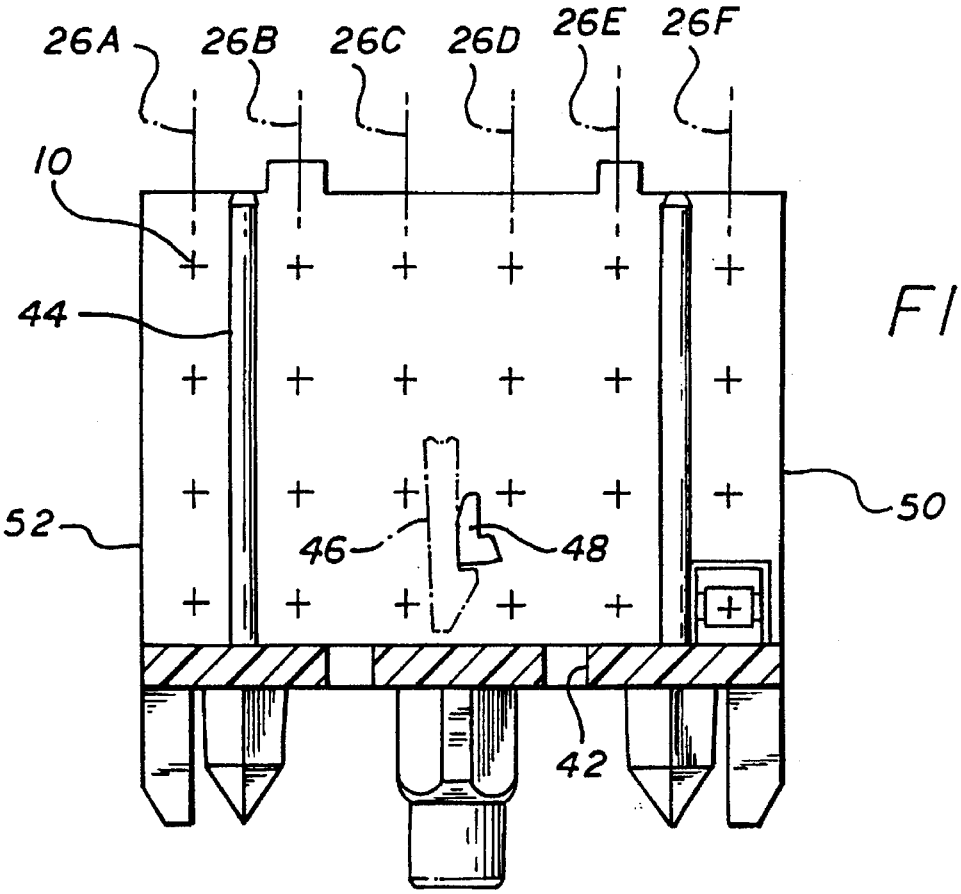
FIG. 4 is a partial view taken on line 4—4 of FIG. 3, but without the contacts and with the contact-holding passages only indicated, and showing only one front module.
Figure 5:
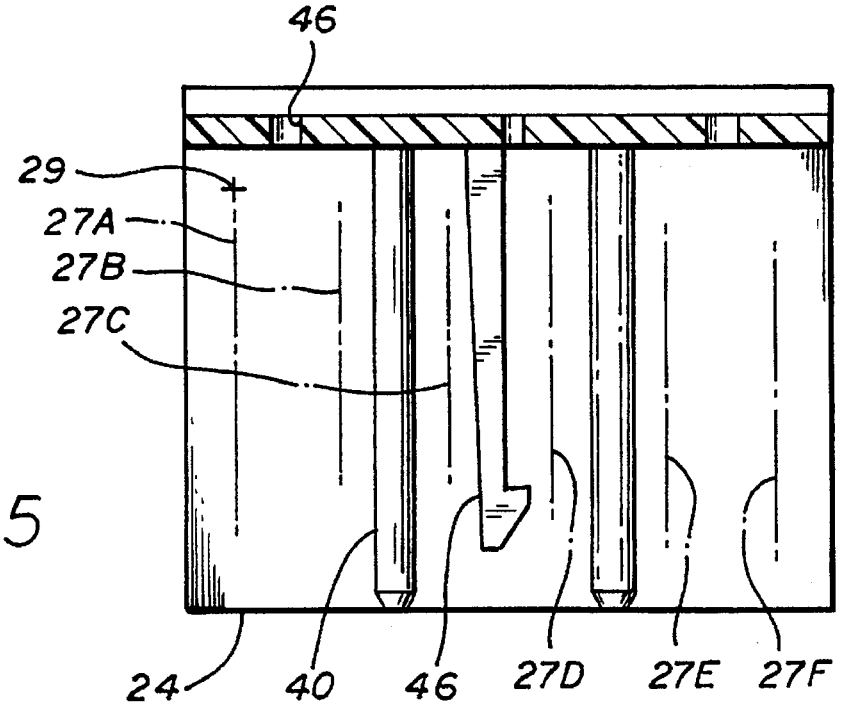
FIG. 5 is a partial view taken on line 5—5 of FIG. 3, and showing only one rear module.

FIG. 4 indicates that the front module 11 has six columns of contact positions 26A–26F. FIG. 5 indicates that the rear module 14 has six columns of contact positions 27A–27F. For the rear module, each contact position such as 29, corresponds to a contact position 10 of a front module. All columns are equally laterally spaced apart, with each module end such as 52 being spaced from an adjacent column 26A by half the lateral spacings of the columns.

As shown in FIG. 1, each module has laterally spaced opposite ends, with the first front module 11 having first and second ends 50, 52, and the second front module 12 having opposite ends 54, 56. Each of the rear modules has opposite ends, with a first rear module 14 having opposite ends 60, 62 and with the second rear module 15 having opposite ends 64, 66. As shown in FIG. 2, the front modules are assembled with their closest ends 56, 50 lying adjacent and substantially abutting one another. Location 16 is where the adjacent ends lie. The rear modules are positioned with ends 62, 64 lying adjacent and substantially abutting at a location 17. It can be seen that the locations 16, 17 where the front and rear modules have adjacent ends, are laterally offset from one another. As a result, the second rear module 15 is attached to both of the front modules 11, 12, to fix their relative positions. Although the relative positions of the front modules 11, 12 are fixed by the circuit board, the presence of the second rear module 15 which spans the location 16 and which is attached to both front modules, further helps stabilize the positions of the front modules. Also, the position of the second rear module 15 is stabilized by the fact that it is attached to two front modules.

Figure 6:
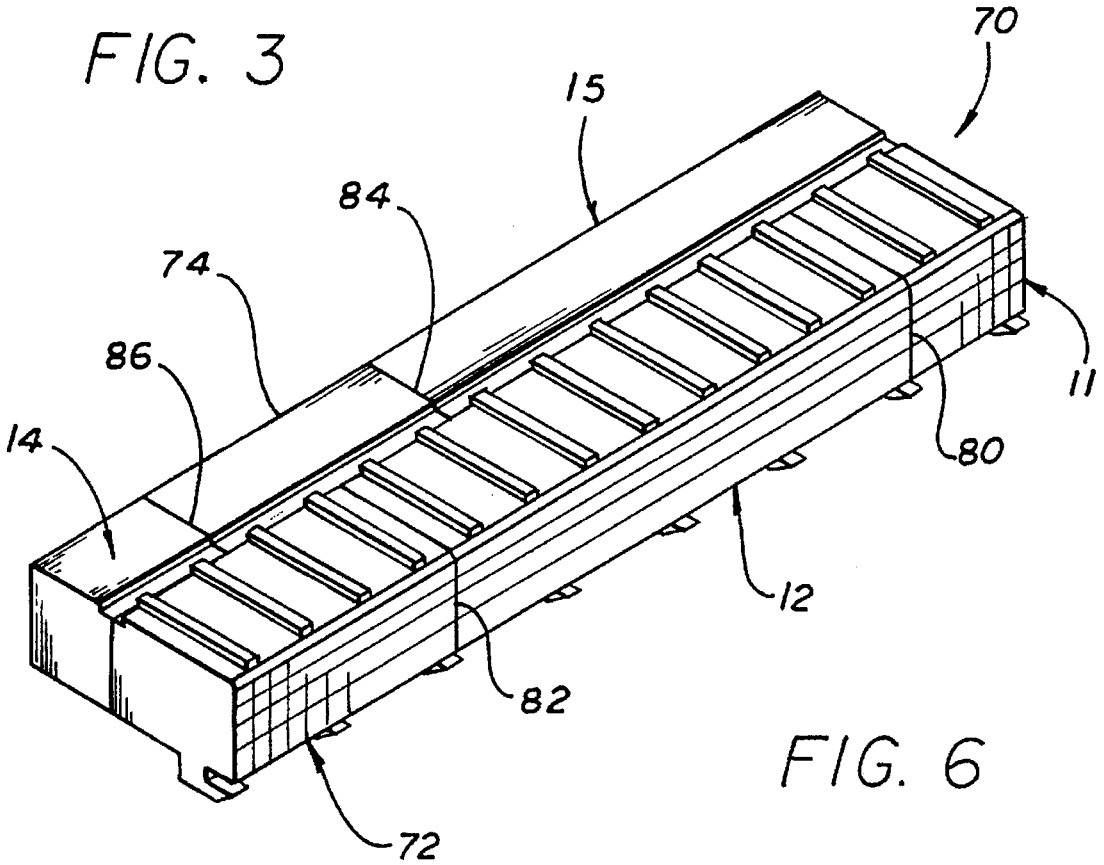
FIG. 6 is an isometric view of a terminal strip similar to that of FIG. 2, which has additional front and rear modules to make it longer.

FIG. 6 illustrates another terminal strip 70 which includes the two front modules 11, 12 and an additional front module 72. While the first module 11 has six columns of contact positions and module 12 has twenty-four columns, the module 72 has twelve columns. This results in a total of 42 columns, and a total of 168 contact positions. The terminal strip 70 includes three rear modules 14, 15, and 74, with each rear module having a length equal to that of one of the front modules 11, 12, 72. Locations 80, 82 of substantially abutting ends of the front modules, are offset from locations 84, 86 of abutting ends of the rear modules.

The provision of a plurality of front module sizes or lengths (for both front and rear modules), where each module has two or four times as many columns of contact positions as those of the smallest module 11, simplifies manufacture and inventory control. It also assures that a minimum number of individual modules will be required to meet any requirement. Where only the small modules 11 are available, as in the prior art, a customer who requires twenty-five contact positions will use two modules, with twenty-three being in excess. No matter how many contact positions the customer requires, it can be met by the prior art, with a maximum excess of twenty-three contact positions, but using a large number of modules. Using only the three modules of FIG. 6, applicant can provide any number of contact positions up to 288, using no more than three modules, with there never being more than twenty-three excess contact positions. In order to achieve this using only prior art small modules of twenty-four contact positions each, requires the use of up to twelve modules for each terminal strip. Where a very large number of contacts may be required, applicant can provide a fourth type of module that has 192 contact positions arranged in 48 columns, to provide up to 768 contact positions using no more than four modules for each strip, with there never being more than twenty-three excess contacts.

Another way of describing the different sizes or lengths of front (and rear) modules that are manufactured, is to first choose a predetermined smallest number of columns for the smallest or shortest module (usually six columns for a total of twenty-four contact positions). All modules have a number of columns equal to the predetermined smallest number (e.g. six) times the number two raised to a non-negative integer ($2^0=1$, $2^1=2$, $2_2=4$, $2^3=8$). The shortest module has a number of columns equal to the predetermined number (e.g. six). All but the shortest module has a number of columns equal to the smallest number times a power of two, where the power is a positive integer ($2^1=2$, $2^2=4$, $2^3=8$, etc.).

As mentioned earlier, applicant prefers to provide a rear module type for each front module type, that both have the same length. Thus, where three front module lengths are provided, applicant prefers to also provide three rear module lengths, which are preferably mounted with offsets.

Figure 7:
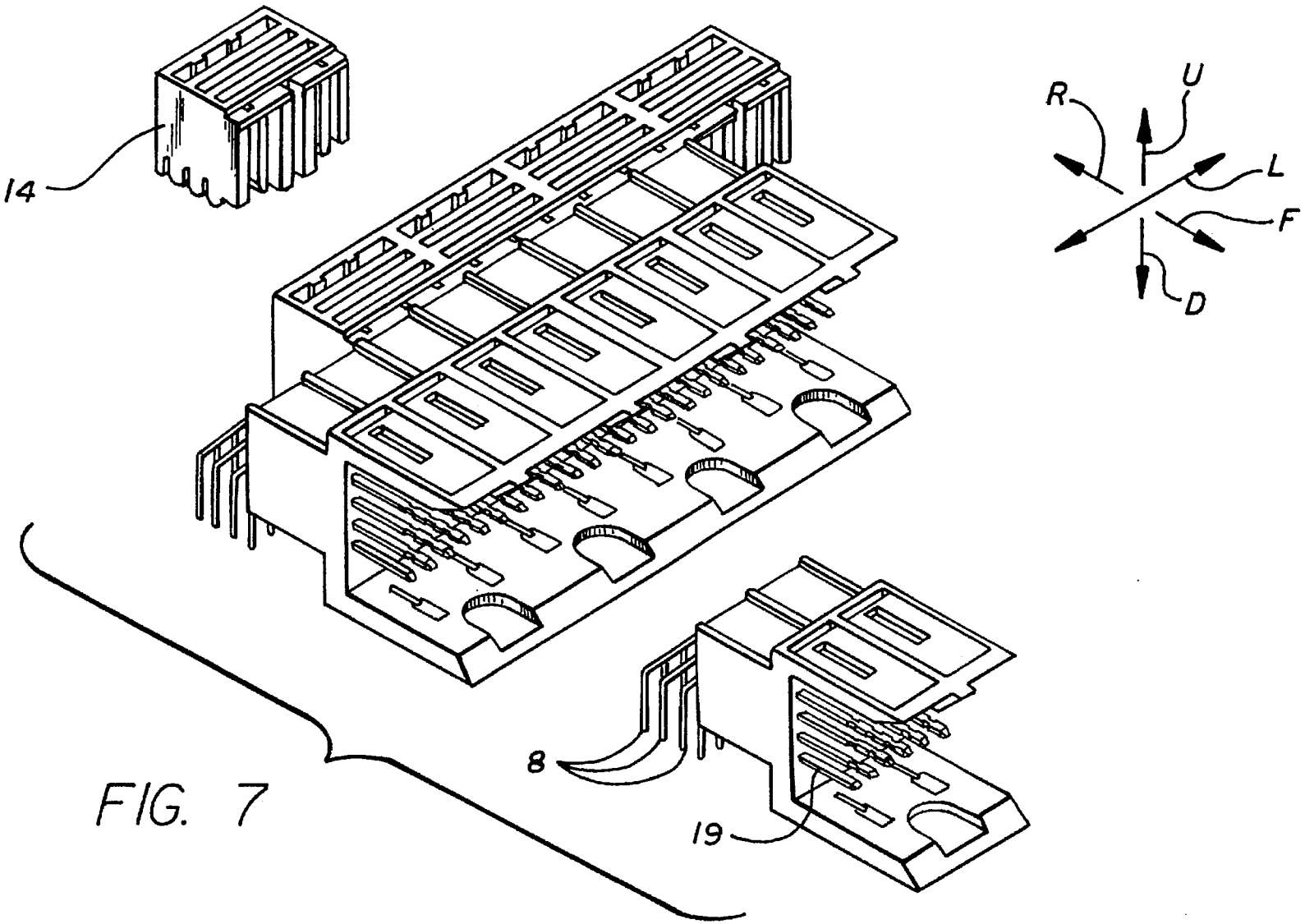
FIG. 7 is an exploded isometric view of a pin terminal strip.
Figure 8:
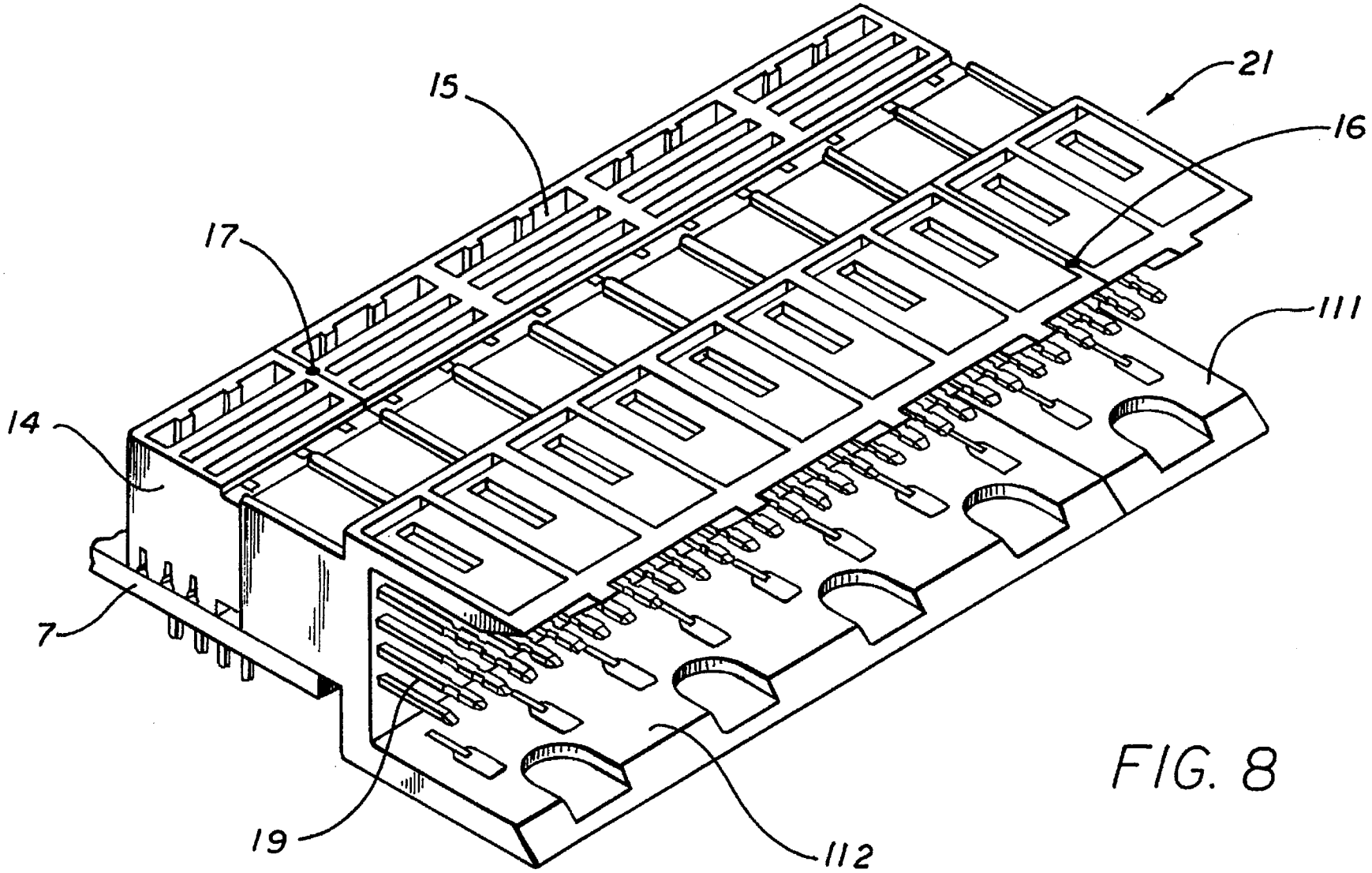
FIG. 8 is an isometric view of the terminal strip of FIG. 7 shown assembled on a circuit board.

FIGS. 7 and 8 show a plug or pin terminal strip 21, which includes front modules 111, 112 which are of the same length as the modules 11, 12 of FIG. 2. However, the front modules of FIGS. 7 and 8 hold contacts with pin ends 19 instead of socket ends. Applicant provides offset rear modules 14, 15 that are the same as the rear modules used in FIGS. 1 and 2.

While upward and downward directions are shown in the figures to help describe the invention as illustrated, the terminal strips and circuit board can be used in any orientation with respect to Earth's gravity.

Thus, the invention provides a terminal strip and construction method therefor, which minimizes the number of different sizes of connector or front modules that must be manufactured and inventoried by the manufacturer or his distributors who produce or store a line of connector modules, while minimizing the number of front modules that a customer must use to construct a terminal strip with any arbitrary number of contacts (with a certain maximum number of excess contact positions). Also, the system provides premanufactured and therefore readily available rear modules that not only cover the rear of a front module, but that are joined to at least two different front modules. A minimum number of module lengths are manufactured and held in inventory, with the smallest module having a predetermined number of columns of contact positions, a next smallest module having twice the predetermined number of columns, and with any third and fourth module size having four and eight times the number of columns, respectively. A corresponding number of different rear module lengths are also provided. The modules are mounted so the abutment locations where ends of two front modules substantially abut one another, are offset from locations where the ends of two rear modules substantially abut one another.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A terminal strip of the type that is constructed to mount on a circuit board and that has a plurality of columns of contact positions, each column including a plurality of contact positions, comprising:

a plurality of front modules that each has laterally-spaced opposite ends, a front, and a rear, said front modules lying end-to-end in a row, with an end of a first of said front module lying adjacent to an end of a second of said front module;

a plurality of rear modules mounted to the rear of said front modules, said rear modules lying end-to-end in a row behind said row of front modules, with an end of a first of said rear module lying adjacent to an end of a second of said rear modules;

said plurality of front and rear modules are laterally offset, with a location lying at the adjacent ends of said first and second rear modules being laterally spaced from a location lying at the adjacent ends of said first and second front modules.

2. The terminal strip described in claim 1 wherein:

said modules are constructed so said first front module and said first rear module each has a predetermined number of columns of contact positions, and said second front module and said second rear module each has a number of columns of contact positions equal to said predetermined number times the number 2 raised to a power that is a positive integer.

3. The terminal strip described in claim 1 wherein:

said first front and rear modules each has a predetermined number of columns of contact positions;

said second front and rear modules each has a number of column positions which is two times said predetermined number;

said plurality of front modules includes a third front module having four times said predetermined number of columns of contact positions, and said plurality of rear modules includes a third rear module having four times said predetermined number of columns of contact positions.

4. A method for constructing a line of connector modules that each has a plurality of laterally-spaced columns of contact positions, each column having a predetermined number of contact positions, so the line includes a minimum number of different lengths of modules and yet can form a terminus strip having a minimum number of columns of contact positions in excess of a given number that is required for a particular application, using a minimum number of individual modules, comprising:

constructing a plurality of different lengths of connector modules where each module has laterally-spaced opposite ends and each particular length of module has a different number of columns of contact positions than those of a different length module, wherein each length of connector module has a number of columns of contacts which is a different non-negative integer power of two times a predetermined number, with a first of said lengths of modules having a number of columns of contacts equal to said predetermined number.

5. The method described in claim 4 including:

mounting a plurality of said connector modules in a laterally-extending row on a circuit board, with an end of each connector module lying adjacent to an end of another connector module;

constructing a multiplicity of rear modules that each has laterally-spaced opposite ends, including constructing a plurality of different lengths of rear modules, wherein each length of rear modules has a number of columns which is a non-negative integer power of two times a predetermined number, with a first of said groups having a number of equally laterally-spaced columns of contacts equal to said predetermined number;

connecting a plurality of said rear modules to said plurality of connector modules, so said rear modules extend in a laterally-extending row on said circuit board, with an end of each rear module lying adjacent to an end of another rear module, and with locations where adjacent ends of said rear modules lie, being laterally offset from locations where adjacent ends of said connector modules lie.

6. A terminal strip that has a plurality of columns of contact positions, each column having the same number of contact positions, comprising:

a plurality of connector modules that each has laterally-spaced opposite ends, said modules lying end-to-end in a row;

said plurality of modules includes a plurality of different lengths of modules, with a first length of module having a predetermined number of columns and a second length of module having twice said predetermined number of columns.

7. The terminal strip described in claim 6 wherein:

said plurality of front modules includes a third length of module having four times said predetermined number of columns of contact positions.

* * * * *